United States Patent [19]

Faulring

[11] Patent Number: 4,511,400

[45] Date of Patent: Apr. 16, 1985

[54] PRODUCTION OF TOOL STEELS USING CHEMICALLY PREPARED $V_2O_3$ AS A VANADIUM ADDITIVE

[75] Inventor: Gloria M. Faulring, Niagara Falls, N.Y.

[73] Assignee: Union Carbide Corporation, Danbury, Conn.

[21] Appl. No.: 588,412

[22] Filed: Mar. 12, 1984

[51] Int. Cl.[3] ..... C22C 33/08

[52] U.S. Cl. ..... 75/129; 75/130 R

[58] Field of Search ..... 75/129, 130 R

[56] References Cited

U.S. PATENT DOCUMENTS

| | | | |
|---|---|---|---|
| 3,410,652 | 11/1968 | Hausen et al. | 23/21 |
| 3,591,367 | 7/1971 | Perfect | 75/133 |
| 4,361,442 | 11/1982 | Faulring et al. | 75/57 |
| 4,396,425 | 8/1983 | Faulring | 75/129 |

*Primary Examiner*—Peter D. Rosenberg

*Attorney, Agent, or Firm*—John R. Doherty

[57] ABSTRACT

Process for producing tool steel wherein a vandadium additive consisting essentially of chemically prepared, substantially pure $V_2O_3$ is added to a molten steel having a carbon content above about 0.35 wt. % and containing silicon in an amount of from about 0.15 to about 3.0 wt. % and wherein a slag covering the molten steel contains CaO and $SiO_2$ in a weight ratio ($CaO/SiO_2$) which is equal to or greater than unity.

12 Claims, 5 Drawing Figures

FIG. 3
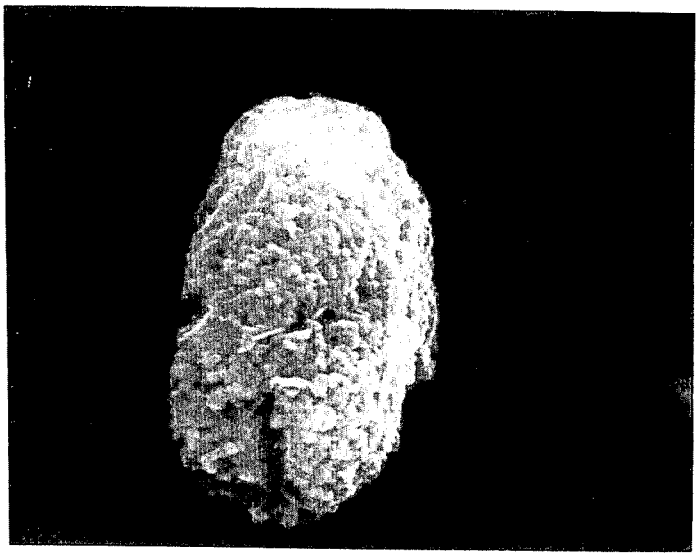
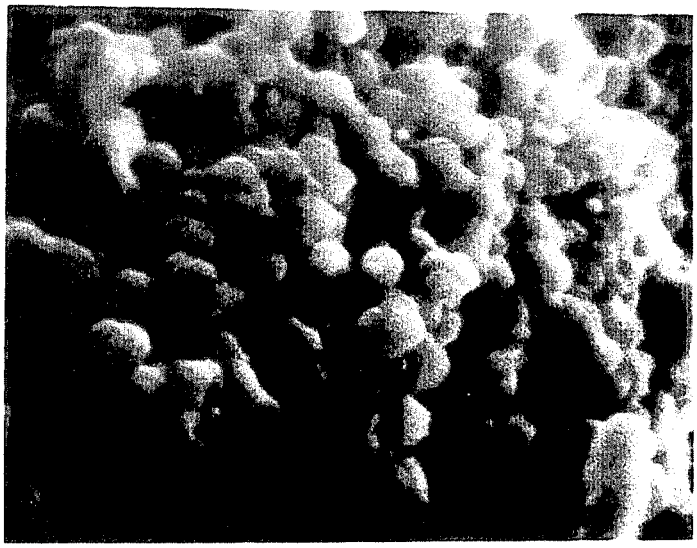
FIG. 4

PARTICLE SIZE DISTRIBUTION OF $V_2O_3$

PRODUCTION OF TOOL STEELS USING CHEMICALLY PREPARED $V_2O_3$ AS A VANADIUM ADDITIVE

BACKGROUND OF THE INVENTION

1. Field of the Invention

The present invention relates to tool steels and more particularly to a process for producing tool steels using chemically prepared, substantially pure vanadium trioxide, $V_2O_3$, as a vanadium additive. In a more specific aspect, the invention relates to the production of tool steels having an intermediate or high carbon content, i.e., above about 0.35 weight percent.

Tool steels are generally produced with a high carbon content, e.g. as high as 5.0 weight percent in some instances. They also contain alloy elements such as vanadium, tungsten, chromium, molybdenum, manganese, aluminum, silicon, cobalt, and nickel. Typically, the vanadium content of tool steels ranges from about 0.4 to 5 weight percent.

Throughout the specification and claims, reference will be made to the term "chemically prepared $V_2O_3$". This vanadium trioxide is prepared according to the teachings of D. M. Hausen et. al, in U.S. Pat. No. 3,410,652 issued on Nov. 12, 1968, the disclosure of which is incorporated herein by reference. As described in that patent, $V_2O_3$ is produced by a process wherein a charge of ammonium metavanadate (AMV) is thermally decomposed in a reaction zone at elevated temperatures (e.g. 580° C. to 950° C.) in the absence of oxygen. This reaction produces gaseous by-products which provide a reducing atmosphere. The $V_2O_3$ is formed by maintaining the charge in contact with this reducing atmosphere for a sufficient time to complete the reduction. The final product is substantially pure $V_2O_3$ containing less than 0.01 percent vanadium nitride. $V_2O_3$ is the only phase detectable by X-ray diffraction.

2. Description of the Prior Art

It is common practice to alloy steel with vanadium by adding ferrovanadium or vanadium carbide ($VC-V_2C$) to the molten steel. The ferrovanadium is commonly produced by the aluminothermal reduction of vanadium pentoxide ($V_2O_5$) or by the reduction of a vanadium-bearing slag or vanadium-bearing residue, for example. Vanadium carbide is usually made in several stages, i.e., vanadium pentoxide or ammonium vanadate is reduced to vanadium trioxide, $V_2O_3$, which in turn is reduced in the presence of carbon to vanadium carbide under reduced pressure at elevated temperatures, (e.g. about 1400° C.). A commercial $VC-V_2C$ additive is produced by Union Carbide Corporation under the trade name "Caravan".

Vanadium additions have also been made by adding vanadium oxide, e.g. $V_2O_5$ or $V_2O_3$, to the molten steel along with a reducing agent. For example, U.S. Pat. No. 4,361,442 issued to G. M. Faulring et. al on Nov. 30, 1982, discloses a process for adding vanadium to steel wherein an addition agent consisting of an agglomerated mixture of finely divided $V_2O_5$ and a calcium-bearing material, e.g. calcium-silicon alloy, is added to the molten steel preferably in the form of a molded briquet.

U.S. Pat. No. 4,396,425 issued to G. M. Faulring et al. on Aug. 2, 1983, discloses a similar process for adding vanadium to steel wherein the addition agent is an agglomerated mixture of finely divided $V_2O_3$ and calcium-bearing material.

U.S. Pat. No. 3,591,367 issued to F. H. Perfect on July 6, 1971, discloses a vanadium addition agent for use in producing ferrous alloys, which comprises a mixture of vanadium oxide, e.g., $V_2O_5$ or $V_2O_3$, an inorganic reducing agent such as Al or Si, and lime. The purpose of the lime is to flux inclusions, e.g. oxides of the reducing agent, and to produce low melting oxidic inclusions that are easily removed from the molten steel.

Vanadium addition agents of the prior art, while highly effective in many respects, suffer from a common limitation in that they often contain residual metals which may be harmful or detrimental to the steel. Even in those cases where the addition agent employs essentially pure vanadium oxide e.g. $V_2O_3$, the reducing agent usually contains a significant amount of metallic impurities. This problem is particularly troublesome in tool steels, which require relatively high levels of vanadium addition.

SUMMARY OF THE INVENTION

In accordance with the present invention, there is provided a novel and improved process for producing tool steel which comprises:

(a) forming a molten steel having a carbon content above about 0.35 weight % and containing silicon in an amount of from about 0.15 to about 3.0 weight percent, and a slag covering the molten steel, the slag containing CaO and $SiO_2$ in proportion such that the weight ratio of CaO to $SiO_2$ is equal to or greater than unity; and (b) adding to the molten steel a vanadium additive consisting essentially of chemically prepared, substantially pure $V_2O_3$ in at least an amount which will react stoichiometrically with carbon and silicon to produce from about 0.4 to about 5.0 weight % vanadium in the molten steel.

It has been surprisingly found in accordance with the present invention that a chemically prepared, substantially pure $V_2O_3$ can be successfully added to a molten steel without a reducing agent to achieve a given level of vanadium addition if the molten steel is made sufficiently reducing by employing (1) a relatively high carbon content, i.e. greater than about 0.35 weight % and (2) silicon as an alloy metal. It is also necessary to employ a slag covering the molten steel which is essentially basic, that is, the slag should have a V-ratio, i.e. CaO to $SiO_2$, which is greater than unity. Preferably, the basic slag is made reducing by adding a reducing element such as carbon, silicon or aluminum.

Tool steels are admirably suited to the employment of chemically prepared $V_2O_3$ as a vanadium additive since these steels require a medium to high carbon content. Furthermore, it is ordinarily required to employ relatively strong reducing conditions in the slag when producing these steels in order to promote recovery of expensive, easily oxidized alloying elements such as Cr, V, W, and Mo.

The use of chemically prepared $V_2O_3$ as a vanadium additive in accordance with the present invention has many advantages over the prior art. First, the $V_2O_3$ is nearly chemically pure, i.e. greater than 97% $V_2O_3$. It contains no residual elements that are detrimental to the steel. Both ferrovanadium and vanadium carbide contain impurities at levels which are not found in chemically prepared $V_2O_3$. Vanadium carbide, for example, is produced from a mixture of $V_2O_3$ and carbon and contains all the contaminants that are present in the carbon as well as any contaminants incorporated during processing. Moreover, the composition and physical properties of chemically prepared $V_2O_3$ are more consistent as compared to other materials. For example, $V_2O_3$ has a fine particle size which varies over a narrow range. This does not apply in the case of ferrovanadium where crushing and screening is required resulting in a wide distribution of particle size and segregation during cooling producing a heterogeneous product. Finally, the reduction of $V_2O_3$ with silicon or aluminum is an exothermic reaction, supplying heat to the molten steel in the electric furnace. ferrovanadium and vanadium carbide both require the expenditure of thermal energy in order to integrate the vanadium into the molten steel.

BRIEF DESCRIPTION OF THE DRAWING

In the accompanying drawing:

FIG. 3 is a photomicrograph taken at a magnification of 10,000X and showing the structure in greater detail of a small particle of $V_2O_3$ shown in FIG. 1;

FIG. 4 is a photomicrograph taken at a magnification of 50,000X and showing the structure in greater detail of the small $V_2O_3$ particle shown in FIG. 3.

DESCRIPTION OF THE PREFERRED EMBODIMENTS

Figure 1:
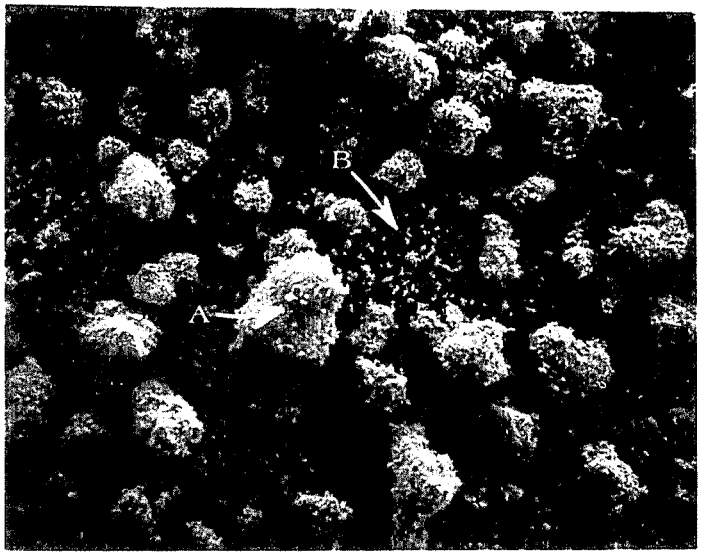
FIG. 1 is a photomicrograph taken at a magnification of 100X and showing a chemically prepared $V_2O_3$ power used as a vanadium additive according to the present invention.

Tool steels are commonly made both with and without an AOD (argon-oxygen decarburization) processing step which occurs after the charge has been melted down in the electric furnace. The production of tool steels according to the present invention shall be described hereinafter without reference to any AOD, although it will be understood that such practices may be employed as a final processing step following vanadium addition using chemically prepared $V_2O_3$. A detailed explanation of the AOD process is driven in U.S. Pat. No. 3,252,790 issued to W. A. Krivsky on May 24, 1966, the disclosure which is incorporated herein by reference.

In the practice of the present invention, a vanadium additive consisting essentially of chemically prepared $V_2O_3$ produced according to Hausen et al in U.S. Pat. No. 3,410,652, supra, is added to a molten tool steel as a finely divided powder or in the form of briquets, without a reducing agent, within the electric furnace or the transfer vessel prior to casting the steel into ingots. The tool steel has a high carbon content, i.e., above about 0.35 wt. percent, and also contains silicon in amounts which are effective to provide a strong reducing environment in the molten steel. Of course, the tool steel may also contain a number of other alloying elements such as, for example, chromium, tungsten, molybdenum, manganese, cobalt and nickel as will readily occur to those skilled in the art.

It is also essential in the practice of the present invention to provide a basic reducing slag covering the molten steel. The slag is generated according to conventional practice by the addition of slag formers such as lime, for example, and consists predominately of CaO and $SiO_2$ along with smaller quantities of FeO, $Al_2O_3$ MgO and MnO, for example. The proportion of CaO to $SiO_2$ is known as the "V-ratio" which is a measure of the basicity of the slag. Preferably, the basic slag is rendered reducing by adding such reducing materials as $CaC_2$, ferrosilicon, silicomanganese and/or aluminum.

It has been found that in order to obtain recoveries of vanadium which are close to 100% using chemically prepared $V_2O_3$ as a vanadium additive, the V-ratio of the slag must be equal to or greater than 1.0. Preferably, the V-ratio is closer to 2.0. Suitable modification of the slag composition can be made by adding lime in sufficient amounts to increase the V-ratio at least above unity. A more detailed explanation of the V-ratio may be found in "Ferrous Productive Metallurgy" by. A. T. Peters, J. Wiley and Sons, Inc. (1982), pages 91 and 92.

The chemically prepared $V_2O_3$ that is used as a vanadium additive in the practice of this invention is primarily characterized by its purity i.e. essentially 97–99% $V_2O_3$ with only trace amounts of residuals. Moreover, the amounts of elements most generally considered harmful in the steel-making process, namely, arsenic, phosphorus and sulfur, are extreme low. Since tool steels contain up to 70 times more vanadium than other grades of steel, the identity and amount of residuals is particularly important. For example, tool steels may contain as much as 5 wt. % vanadium whereas microalloyed high strength, low alloy (HSLA) steels contain less than 0.2 wt. % vanadium.

Table I below shows the chemical analysis of a typical chemically prepared $V_2O_3$ material:

TABLE I

Chemical Analysis of $V_2O_3$

| Element or Compound | Weight Percent Typical | Weight Percent Maximum |
|---|---|---|
| V | 66.1 (97.2% $V_2O_3$) | 67 (98.6% $V_2O_3$) |
| Alkali ($Na_2O_3$ + $K_2O$) | 0.3– | 1.0 |
| As | | 0.01 |
| Cu | | 0.05 |
| Fe | | 0.1 |
| Mo | | 0.05 |
| P | | 0.03 |
| $SiO_2$ | | 0.25 |
| S | | 0.02 |

X-ray diffraction data obtained on a sample of chemically prepared $V_2O_3$ shows only one detectable phase, i.e. $V_2O_3$. Based on the lack of line broadening or intermittent-spotty X-ray diffraction reflections, it was concluded that the $V_2O_3$ crystallite size is between $10^{-3}$ and $10^{-5}$ cm.

The chemically prepared $V_2O_3$ is also very highly reactive. It is believed that this reactivity is due mostly to the exceptionally large surface area and high melting point of the $V_2O_3$. Scanning electron microscope (SEM) images were taken on samples to demonstrate the large surface area and porosity of the $V_2O_3$ material. FIGS. 1–4, inclusive, show these SEM images.

FIG. 1 is an image taken at 100X magnification of a sample $V_2O_3$. As shown, the $V_2O_3$ is characterized by agglomerate masses which vary in particle size from about 0.17 mm and down. Even at this low magnification, it is evident that the larger particles are agglomerates of numerous small particles. For this reason, high magnification SEM images were taken on one large particle designated "A" and one small particle designated "B".

Figure 2:
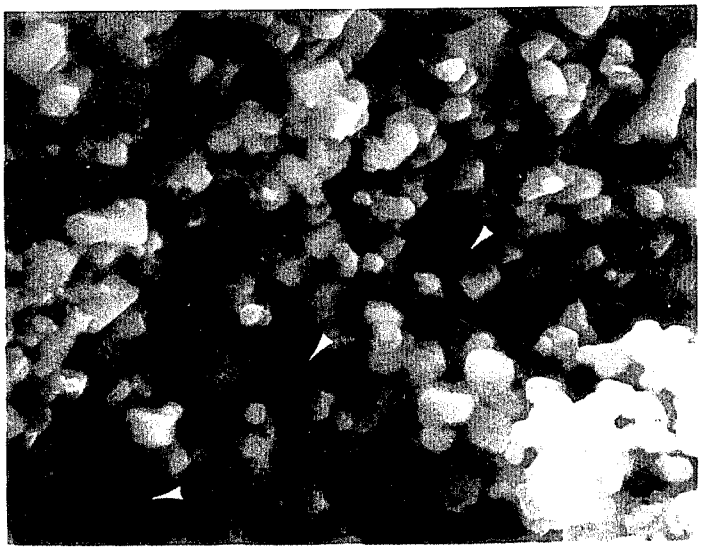
FIG. 2 is a photomicrograph taken at a magnification of 10,000X and showing in greater detail the structure of a large particle of $V_2O_3$ shown in FIG. 1.

The SEM image of the large particle "A" is shown in FIG. 2. It is apparent from this image that the large particle is a porous agglomerated mass of extremely small particles, e.g. 0.2 to 1 micron. The large amount of nearly black areas (voids) on the SEM image is evidence of the large porosity of the $V_2O_3$ masses. See particularly the black areas emphasized by the arrows in the photomicrographs. It will also be noted from the images that the particles are nearly equidimensional.

FIG. 3 is an image taken at 10,000X magnification of the small particle "B". The small particle or agglomerate is about 4×7 microns in size and consists of numerous small particles agglomerated in a porous mass. A higher magnification image (50,000X) was taken of this same small particle to delineate the small particles of the agglomerated mass. This higher magnification image is shown in FIG. 4. It is evident from this image that the particles are nearly equidimensional and the voids separating the particles are also very much apparent. In this agglomerate, the particles are in a range of about 0.1 to 0.2 microns.

Figure 5:
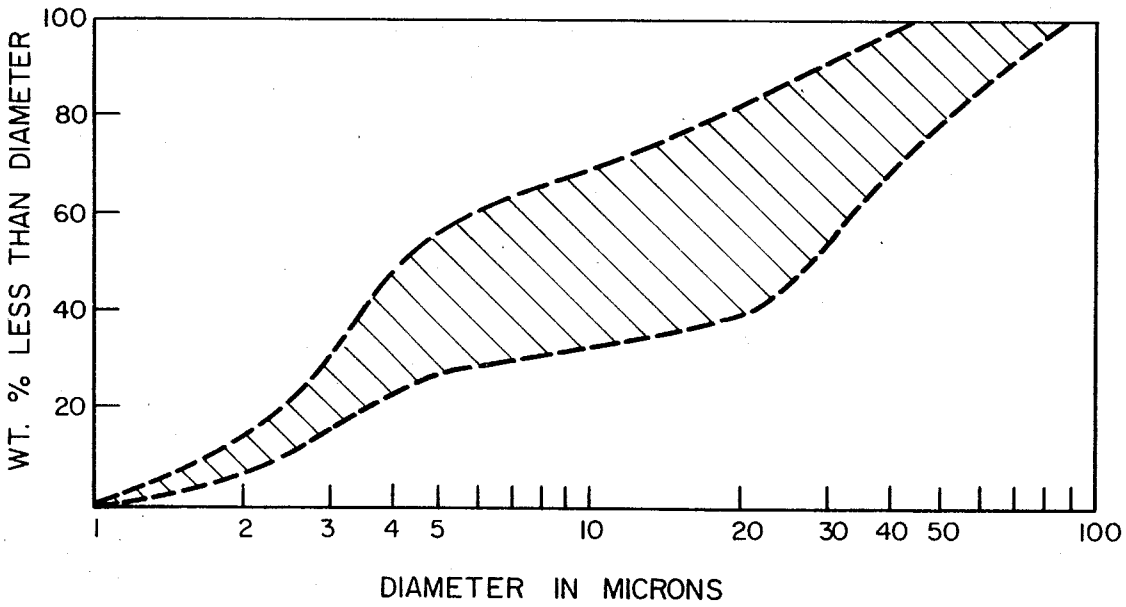
FIG. 5 is a graph showing the particle size distribution of a typical chemically prepared, $V_2O_3$ powder.

FIG. 5 shows the particle size distribution of chemically prepared $V_2O_3$ material from two different sources. The first is the same $V_2O_3$material shown in FIGS. 1–4. The second $V_2O_3$ material has an idiomorphic shape due to the relatively slow recrystallization of the ammonium metavanadate. The size of the individual particle is smaller in the case of the more rapidly recrystallized $V_2O_3$ and the shape is less uniform. The particle size was measured on a micromerograph and the particles were agglomerates of fine particles (not separated-distinct particles). It will be noted from the graph that 50 wt. % of all the $V_2O_3$ had a particle size distribution of between 4 and 7 microns.

The bulk density of the chemically prepared $V_2O_3$ prior to milling is between about 45 and 65 lb/cu.ft. Preferably, $V_2O_3$ is milled to increase its density for use as a vanadium additive. Milling produces a product that has a more consistent density and one that can be handled and shipped at lower cost. Specifically, the milled $V_2O_3$ has a bulk density of about 70 to 77 lb/cu. ft.

The porosity of the chemically prepared $V_2O_3$ has been determined from the measured bulk and theoretical densities. Specifically, it has been found that from about 75 to 80 percent of the mass of $V_2O_3$ is void. Because of the minute size of the particles and the very high porosity of the agglomerates, chemically prepared $V_2O_3$ consequently has an unusually large surface area. The reactivity of the chemically prepared $V_2O_3$ is related directly to this surface area. The surface area of the $V_2O_3$ was calculated from the micromeograph data as exceeding 140 sq. ft. per cubic inch or 8000 sq. centimeters per cubic centimeter.

Aside from its purity and high reactivity, chemically prepared $V_2O_3$ has other properties which make it ideal for use as a vanadium additive. For instance, $V_2O_3$ has a melting point (1970° C.) which is above that of most steels (1600° C.) and is therefore solid and not liquid under typical steel-making conditions. Moreover, the reduction of $V_2O_3$ with the reducing agent in the molten steel, e.g., AL and Si, under steel-making conditions is exothermic. In comparison, vanadium pentoxide ($V_2O_5$) also used as a vanadium additive together with a reducing agent, has a melting point (690° C.) which is about 900° C. below the temperature of molten steel and also requires more stringent reducing conditions to carry out the reduction reaction. A comparison of the properties of both $V_2O_3$ and $V_2O_5$ is given in Table II below:

TABLE II

Comparison of Properties of $V_2O_5$ and $V_2O_3$

| Property | $V_2O_3$ | $V_2O_5$ |
|---|---|---|
| Density | 4.87 | 3.36 |
| Melting Point | 1970° C. | 690° C. |
| Color | Black | Yellow |
| Character of Oxide | Basic | Amphoteric |
| Composition | 68% V + 32% O | 56% V + 44% O |
| Free Energy of Formation (1900° K.) | −184,500 cal/mole | −202,000 cal/mole |
| Crystal Structure | $a_o$ = 5.45 ± 3 A<br>a = 53°49" ± 8"<br>Rhombohedral | $a_o$ = 4.369 ± 5 A<br>$b_o$ = 11.510 ± 8 A<br>$c_o$ = 3.563 ± 3 A<br>Orthohrombic |

In further comparison, $V_2O_5$ is considered a strong flux for many refractory materials commonly used in electric furnaces and ladles. In addition, $V_2O_5$ melts at 690° C. and remains a liquid under steel-making conditions. The liquid $V_2O_5$ particles coalesce and float to the metal-slag interface where they are diluted by the slag and react with basic oxides, such as CaO and $Al_2O_3$. Because these phases are different to reduce and the vanadium is distributed throughout the slag volume producing a dilute solution, the vanadium recovery from $V_2O_5$ is appreciably less than from the solid, highly reactive $V_2O_3$.

Since chemically prepared $V_2O_3$ is both solid and exothermic with silicon or aluminum under tool steel-making conditions, it will be evident that the particle size of the oxide and consequently the surface area are major factors in determining the rate and completeness of the reduction. The reduction reaction may be represented by the following equation:

$$V_2O_3 + \begin{matrix} Al \\ Si \\ C \end{matrix} \longrightarrow V + \begin{matrix} Al_2O_3 \\ SiO_2 \\ CO_2 + CO \end{matrix}$$

The speed of the reaction is maximized under the reducing conditions prevailing in the electric furnace, that is, extremely small particles of solid $V_2O_3$ distributed throughout a molten steel bath containing Si and C. All of these factors contribute to create ideal conditions for the complete and rapid reduction of $V_2O_3$ and solubility of the resulting vanadium in the molten steel.

It has been found that in order to obtain vanadium recoveries that are close to 100 percent using chemically prepared $V_2O_3$ as an additive in the practice of the present invention, the molten steel should contain silicon in a certain specific range, that is, from about 0.15 to 3.0 weight percent. Aluminum may also be present in the molten steel in amounts from 0.0 to less than 0.10 weight percent for deoxidizing the bath. It is, of course, necessary in any case that the carbon content of the molten steel is greater than about 0.35 weight percent in order to provide the required reducing conditions.

As indicated earlier, the V-ratio is defined as the % CaO/%$SiO_2$ ratio in the slag. Increasing the V-ratio is a very effective way of lowering the activity of $SiO_2$ and increasing the driving force for the reduction reaction of Si. The equilibrium constant K for a given slag-metal reaction when the metal contains dissolved Si and $O_2$ under steel-making conditions (1600° C.) can be determined from the following equation:

$$K = \frac{a\ SiO_2}{(a\ Si)\ (a\ O)^2} = 28997$$

wherein "K" equals the equilibrium constant; "a $SiO_2$" equals the activity of the $SiO_2$ in the slag; "a Si" equals the activity of the Si dissolved in the molten metal, and "a O" equals the activity of the oxygen also dissolved in the molten steel.

For a given V-ratio, the activity of the silica can be determined from a standard reference such as "The AOD Process"—Manual for AIME Educational Seminar, as set forth in Table III below. Based on these data and published equilibrium constants for the oxidation of silicon and vanadium, the corresponding oxygen level for a specified silicon content can be calculated. Under these conditions, the maximum amount of $V_2O_3$ that can be reduced and thus the amount of vanadium dissolved in the molten metal can also be determined.

TABLE III

Effect of V-ratio on a $SiO_2$

| V-ratio | a $SiO_2$ |
|---|---|
| 0 | 1.00 |
| 0.25 | 0.50 |
| 0.50 | 0.28 |
| 0.75 | 0.20 |
| 1.00 | 0.15 |
| 1.25 | 0.11 |
| 1.50 | 0.09 |
| 1.75 | 0.08 |
| 2.00 | 0.07 |

Table IV below shows the V-ratios for decreasing $SiO_2$ activity, the corresponding oxygen levels, and the maximum amount of $V_2O_3$ that may be reduced under these conditions. The vanadium that is dissolved in that molten steel as a result of this reduction reaction is also shown for each V-ratio.

TABLE IV

| Slag | | Steel* | | |
|---|---|---|---|---|
| Slag V Ratio (% CaO/% $SiO_2$) | a $SiO_2$** | Oxygen Content of Steel O (ppm) | V Dissolved in Steel % | Amount of $V_2O_3$ Reduced % |
| 0 (acid slag) | 1.0 | 107 | 1.2 | 1.8 |
| 1.00 | 0.15 | 41 | 5.04 | 7.5 |
| 1.25 | 0.11 | 36 | 6.24 | 9.3 |
| 2.00 | 0.07 | 28 | 8.93 | 13.3 |

*Steel contains 0.3 wt. % silicon
**Reference - "The AOD Process" - Manual for AIME Educational Seminar.

Thus, from the above calculations based on a steel containing 0.3 weight percent Si and a variable V-ratio, it may be concluded that with an increase in the V-ratio from 1 to 2 there is a 1.8 times increase in the amount of vanadium that can be reduced from the $V_2O_3$ and incorporated into the molten steel at 1600° C.

It is possible of course to produce a $V_2O_3$ containing material other than by the chemical method disclosed in U.S. Pat. No. 3,410,652, supra. For example, $V_2O_3$ can be prepared by hydrogen reduction of $NH_4VO_2$. This is a two-stage reduction, first at 400°-500° C. and then at 600°-650° C. The final product contains about 80% $V_2O_3$ plus 20% $V_2O_4$ with a bulk density of 45 lb/cu. ft. The state of oxidation of this product is too high to be acceptable for use as a vanadium addition to steel.

The following examples will further illustrate the present invention:

EXAMPLE I

A M-7 Grade tool steel was prepared in the manner set forth below. This alloy has the following chemistry: 1.0 to 1.04 wt % C; 0.2 to 0.35 wt % Mn; 0.3 to 0.55 wt. % Si; 3.5 to 4.0 wt. % Cr; 1.5 to 2.0 wt. % V; 1.5 to 2.0 wt. % W; and 8.2 to 8.8 wt. % Mo.

10 tons of scrap steel containing 130 lbs. of vanadium plus 160 lbs. of molybdenum-tungsten oxide and 80 lbs. of vanadium as $V_2O_3$ were added to an electric furnace. The total charge was melted down under a basic slag (V-ratio=3). The slag was then made reducing by adding $CaC_2$ and ferrosilicon to the melt. The reducing materials were integrated into the slag by hand mixing plus the stirring action of the furnace electrodes. After 1 hour the sample of the molten metal was analyzed. The vanadium content was 1.05 wt. %. The slag was removed and 152 lbs. of vanadium as ferrovanadium (190 lbs. FeV—80% V) was added. A second slag was formed by adding lime (CaO), $CaC_2$ and ferrosilicon. After 30 minutes, a second sample of the molten steel (1600° C.) was taken and analyzed. The reported vanadium content was 1.70 wt. %. The vanadium recoveries for the $V_2O_3$ and ferrovanadium additives are given below:

(1) before addition of $V_2O_3$ —0.64 wt. % V (from scrap).
(2) after addition of $V_2O_3$—1.05 wt. % V (% V recovered=100%).
(3) after addition of FeV—1.70 wt. % (% V recovered—88%).

Based on the precision of the vanadium analysis and sampling, it may be concluded that the recovery from the $V_2O_3$ under these conditions is 98 to 100% and from the ferrovanadium 86-90%.

EXAMPLE II 430 lbs. of vanadium as chemically prepared $V_2O_3$ powder and 10 lbs of vanadium as sodium silicate bonded $V_2O_3$ briquets were added to an M7 Grade tool steel furnace melt weighing about 25 tons. The melt had a carbon content of 0.65 wt. % and also contained initially 0.72 wt. % vanadium. In order to make the basic slag (V-ratio=1.54) reducing, ferrosilicon (75% silicon) and aluminum powder were added. The slag weighed approximately 200 lbs. The $V_2O_3$ powder disappeared quickly into the melt as soon as it was added while the briquets remained floating on the melt surface. The electric furnace was reactivated at 1600° C. for about 1 to 2 minutes followed by a 30-40 second stir with nitrogen. The briquets immediately submerged and disappeared into the melt. A sample of the melt was analyzed and found to contain 1.71 wt. % vanadium. Assuming 100% vanadium recovery of the $V_2O_3$ powder, the vanadium analysis would be 1.61 wt. %. It was estimated therefore that 0.1 wt. % of the vanadium in the steel was reduced from the slag. The steel melt was then poured into a ladle and transferred to an AOD vessel. The transfer weight was 76,600 lbs. After processing in the AOD, the molten steel was poured into ingots. The final composition of the steel was as follows: 1.00 wt. % C; 0.18 wt. % Mn; 0.42 wt. % Si; 3.55 wt. % Cr; 1.66 wt. % W; 1.96 wt. % V; and 8.56 wt. % Mo.

EXAMPLE III 240 lbs. of vanadium as sodium silicate bonded, chemically prepared $V_2O_3$ briquets were added to an M7 Grade tool steel furnace melt weighing about 25 tons.

The melt had a carbon content of 0.7 wt. % and also contained initially 0.98 wt. % vanadium. 150 lbs. of 75% FeSi and 150 lbs. of Al powder were added with the $V_2O_3$ briquets to insure that the basic slag was reducing. The slag weighed approximately 200 lbs. The slag analysis was 16.54% Ca and 10.29% Si giving a V-ratio of 1.05. After addition (about 1 min.) the briquets were observed still floating on the surface of the melt. The electric furnace was reactivated at 1600° C. after which the briquets were reduced and disappeared into the melt. The melt was poured into a ladle, returned to the electric furnace and poured again into the ladle for transfer to an AOD vessel. A sample of the melt in the ladle was analyzed and found to contain 1.69 wt. % vanadium. Vanadium recovery from the $V_2O_3$ briquets in the furnace was estimated to be 100%. Approximately 108 lbs. of vanadium (about 0.20 wt. %) was also reduced from the slag. The slag in the ladle contained 21.13% Ca and 10.45% Si giving a V-ratio of 1.26%. Next 130 lbs. of vanadium was added as $V_2O_3$ powder to the molten steel in the transfer ladle bringing the vanadium content to 1.9 wt. %. After the AOD, the molten steel was poured into ingots. The final composition of the steel was as follows: 1.02 wt. % C; 0.25 wt. % Mn; 0.45 wt. % Si: 3.40 wt. % Cr; 1.64 wt. % W; 1.92 wt. % V; 8.40 wt. % Mo.

I claim:

1. A process for producing tool steel which comprises:

(a) forming a molten steel having a carbon content above about 0.35 weight percent and containing silicon in an amount of from about 0.15 to about 3.0 weight percent, and a slag covering the molten steel, the slag containing CaO and $SiO_2$ in proportion such that the weight ratio of CaO to $SiO_2$ is equal to or greater than unity; and (b) adding to the molten steel a vanadium additive consisting essentially of finely divided chemically prepared, substantially pure $V_2O_3$ in at least an amount which will react stoichiometrically with said carbon and silicon to produce from about 0.4 to about 5.0 weight percent vanadium in the molten steel.

2. A process according to claim 1 wherein the weight ratio of CaO to $SiO_2$ in the slag is equal to or greater than 2.

3. A process according to claim 1 wherein the slag is made reducing by the addition of a material selected from the group consisting of calcium carbide, ferrosilicon and silicomanganese.

4. A process according to claim 1 wherein the molten metal contains less than about 0.10 wt. % aluminum.

5. A process according to claim 1 wherein the chemically prepared, substantially pure $V_2O_3$ has a surface area which is greater than about 8000 sq. centimeters per cubic centimeter.

6. A process according to claim 1 wherein the chemically prepared, substantially pure $V_2O_3$ is milled to a bulk density of about 70 to 77 lb./cu. ft.

7. A process for producing tool steel which comprises:

(a) forming a molten steel having a carbon content above about 0.35 weight percent and containing silicon in an amount of from about 0.15 to about 3.0 weight percent, and a slag covering the molten steel, the slag containing CaO and $SiO_2$ in proportion such that the weight ratio of CaO to $SiO_2$ is equal to or greater than unity; and (b) adding finely divided, chemically prepared, substantially pure $V_2O_3$ to the molten steel as a vanadium additive without a reducing agent admixed in intimate contact therewith, the amount of $V_2O_3$ added to the molten steel being sufficient to react stoichiometrically with said carbon and silicon to produce from about 0.4 to about 5.0 weight percent vanadium in the molten steel.

8. A process for producing tool steel which comprises:

(a) forming a molten steel having a carbon content above about 0.35 weight percent and containing silicon in an amount of from about 0.15 to about 3.0 weight percent, and aluminum in an amount of less than about b 0.10 weight percent, and a slag covering the molten steel, the slag containing CaO and $SiO_2$ in proportion such that the weight ratio of CaO to $SiO_2$ is equal to or greater than unity; and (b) adding finely divided, chemically prepared, substantially pure $V_2O_3$ to the molten steel as a vanadium additive without a reducing agent admixed in intimate contact therewith, the amount of finely divided $V_2O_3$ added to the molten steel being sufficient to react stoichiometrically with said carbon and silicon to produce from about 0.4 to about 5.0 weight percent vanadium in the molten steel, said finely divided $V_2O_3$ having a surface area greater than about 8,000 sq. centimeters per cubic centimeter and a bulk density of about 70 to 77 pounds per cubic foot.

9. A process according to claim 8 wherein the weight ratio of CaO to $SiO_2$ in the slag is equal to or greater than 2.

10. A process according to claim 8 wherein the slag is made reducing by the addition of a material selected from the group consisting of calcium carbide, ferrosilicon and silicomanganese.

11. A process according to claim 8 wherein 50 weight percent of the finely divided $V_2O_3$ has a particle size distribution of between 4 and 7 microns.

12. A process according to claim 8 wherein the finely divided $V_2O_3$ has a void volume of from about 75 to 80 percent.

* * * * *

UNITED STATES PATENT AND TRADEMARK OFFICE

CERTIFICATE OF CORRECTION

PATENT NO. : 4,511,400

DATED : April 16, 1985

INVENTOR(S) : Gloria M. Faulring

It is certified that error appears in the above-identified patent and that said Letters Patent is hereby corrected as shown below:

Column 3, line 46, "driven" should read -- given --.

Column 5, line 62, "AL" should read -- Al --.

Column 10, line 27, delete "b".

Signed and Sealed this

*Fifteenth* Day of *October 1985*

[SEAL]

*Attest:*

*Attesting Officer*

DONALD J. QUIGG

*Commissioner of Patents and Trademarks—Designate*